United States Patent [19]

Wörwag

[11] Patent Number: 4,776,059

[45] Date of Patent: Oct. 11, 1988

[54] VACUUM-CLEANING APPARATUS

[75] Inventor: Peter Wörwag, Romanshorn, Switzerland

[73] Assignee: Düpro AG, Romanshorn, Switzerland

[21] Appl. No.: 151,917

[22] Filed: Feb. 3, 1988

[30] Foreign Application Priority Data

Feb. 5, 1987 [DE] Fed. Rep. of Germany ..... 3703386

[51] Int. Cl.[4] ..... A47L 9/04

[52] U.S. Cl. ..... 15/334; 15/331; 15/387; 15/416

[58] Field of Search ..... 15/416, 331, 334, 377, 15/387

[56] References Cited

U.S. PATENT DOCUMENTS

| | | | |
|---|---|---|---|
| 2,142,978 | 1/1939 | Eriksson-Jons | 15/416 |
| 2,348,861 | 5/1944 | Smellie | 15/416 X |
| 4,023,234 | 5/1977 | Martinec et al. | 15/331 |
| 4,723,338 | 2/1988 | Otsubo | 15/331 |

FOREIGN PATENT DOCUMENTS

| | | | |
|---|---|---|---|
| 2053055 | 5/1972 | German Democratic Rep. | 15/416 |
| 1173623 | 7/1964 | Fed. Rep. of Germany | 15/416 |
| 1208457 | 1/1966 | Fed. Rep. of Germany | 15/334 |
| 414601 | 8/1934 | United Kingdom | 15/334 |

*Primary Examiner*—Chris K. Moore

*Attorney, Agent, or Firm*—Becker & Becker, Inc.

[57] ABSTRACT

A vacuum-cleaning apparatus for cleaning furniture or the like, especially upholstered furniture, upholstered vehicle seats, etc. The apparatus is connected via a vacuum conduit to a vacuum-cleaning unit. A first vacuum nozzle is provided with a brush and includes a housing having an intake opening that leads to the vacuum conduit. A second vacuum nozzle is embodied as a gap-cleaning nozzle and is pivotable, relative to the first vacuum nozzle, out of an inoperative position into an operative position, and vice versa. An air duct is pivotably mounted in the housing. In the operative position of the gap-cleaning nozzle, the latter communicates via the air duct with the intake opening of the housing to provide flow communication from the gap-cleaning nozzle to the vacuum conduit.

20 Claims, 9 Drawing Sheets

VACUUM-CLEANING APPARATUS

BACKGROUND OF THE INVENTION

The present invention relates to a vacuum-cleaning apparatus or tool for cleaning furniture or other upholstered surfaces.

To clean upholstered surfaces, for example of upholstered furniture, seat and back surfaces of the seats of vehicles, etc., that are provided with a textile covering, vacuum-cleaning tools are used that are connected via a suction conduit or hose to a stationary or portable vacuum-cleaning unit. Since these upholstered surfaces predominantly have to be cleaned dry, the vacuum-cleaning tool must be provided with a brush unit to achieve a thorough cleaning effect. As a result, not only is dirt taken up by the stream of intake suction air, but dirt particles are also mechanically loosened from the upholstery covering. To clean the gaps or spaces between the seat and/or back cushions, it is necessary to have a flat vacuum nozzle, a so-called gap-cleaning nozzle, that can reach into the gaps and spaces between individual adjacent portions of cushions, where dust and dirt can settle particularly easily. Such a gap-cleaning nozzle is necessary because the vacuum nozzles that are used for cleaning the upholstered surfaces are too large to be inserted into the narrow and difficult-to-reach gaps or spaces between the cushions. On the other hand, however, the gap-cleaning nozzle is not suitable for cleaning the upholstered surfaces. For this reason, with the heretofore known vacuum-cleaning apparatus the vacuum nozzle and the gap-cleaning nozzle must be exchanged relatively frequently during a cleaning process. This repeated exchange of the two vacuum nozzles is extremely tedious, and makes the cleaning of upholstered furniture and vehicle seats very time consuming. This has a particularly detrimental effect on commercial cleaning costs. To avoid these drawbacks, a vacuum-cleaning tool was proposed (German Offenlegungsschrift 20 52 606) where the entire nozzle body is pivotable about a connection adapter that can be detachably connected to the vacuum conduit. The nozzle body is partially embodied as a flat nozzle having a brush unit, and partially as a gap-cleaning nozzle. However, this nozzle construction has the drawback that the fixed brush unit of the flat nozzle can be moved over the surface that is to be cleaned only with considerable expenditure of force by the operator, since the stiff bristles can catch very severely in the textile covering of the upholstered surface This leads to easy tiring of the operator and to inadequate cleaning results, especially during commercial cleaning, for example of the upholstered seats in buses, taxis, passenger railway cars, etc. A particular drawback is that the gap-cleaning nozzle projects relatively far beyond the other part of the nozzle body. As a result, the operator frequently bumps the gap-cleaning nozzle against furniture, or gets caught on the latter. This is particularly troublesome, and requires increased attentiveness in order to avoid damages. Finally, the shifting of the vacuum nozzle from the flat nozzle to the gap-cleaning nozzle, and vice versa, requires a relatively high expenditure of energy because in order to accomplish this shift, the entire vacuum-cleaning nozzle has to be pivoted.

It is an object of the present invention to provide a vacuum-cleaning apparatus of the aforementioned general type where via a straightforward and easy operation, a strong stream of intake or suction air can be produced in the gap-cleaning nozzle for an extensive and thorough cleaning of even narrow, difficult-to-reach spaces or gaps. cl BRIEF DESCRIPTION OF THE DRAWINGS This object, and other objects and advantages of the present invention, will appear more clearly from the following specification in conjunction with the accompanying schematic drawings, in which.

SUMMARY OF THE INVENTION

The vacuum-cleaning apparatus of the present invention comprises: a first vacuum nozzle, which is provided with a brush and includes a housing having a first intake opening that leads to the vacuum conduit; a second vacuum nozzle, which is embodied as a gap-cleaning nozzle and is pivotable, relative to the first vacuum nozzle, out of an inoperative position into an operative position, and vice versa; and an air duct that is pivotably mounted in the housing and has two ends, one of which is provided with an inlet opening, and the other of which is provided with an outlet opening, whereby in the operative position of the gap-cleaning nozzle, the latter communicates with the inlet opening of the air duct, and the outlet opening of the air duct is aligned with the first intake opening of the housing to provide flow communication from the gap-cleaning nozzle to the vacuum conduit.

As a consequence of the inventive configuration, the second vacuum nozzle, namely the gap-cleaning nozzle, communicates in its operative position via its suction or air passage, and via the inventive air duct, with the intake opening of the housing. In this way, in the vicinity of the intake opening of the gap-cleaning nozzle, there is produced a very strong stream of intake or suction air, via which dirt and dust particles can be loosened out of, and removed from, narrow gaps and the like. Thus, a simple and thorough cleaning is assured without the need for a structurally complicated tool. It is furthermore advantageous if the second vacuum nozzle, i.e. the gap-cleaning nozzle, when it is in its inoperative position, is disposed within the outer contour of the housing of the first vacuum nozzle, and does not project beyond the latter. In this position, the gap-cleaning nozzle does not get in the way when the first vacuum nozzle is being used to clean upholstered surfaces or the like. However, by merely pivoting the gap-cleaning nozzle relative to the first vacuum nozzle, the gap-cleaning nozzle can be shifted outwardly out of its inoperative position and into its operative position. As a result, the gap-cleaning nozzle is always immediately ready for use in a simple manner, or can appropriately be easily pivoted back into its inoperative position. An optimum and extremely thorough cleaning of the entire upholstered region is possible without tiring by using the inventive combination of a gap-cleaning nozzle and the first vacuum nozzle that has a rotating brush, with these nozzles being able to be selectively adapted to the cleaning region that is encountered at any given time by a simple operation.

Further specific features of the present invention will be described in detail subsequently.

Description of Preferred Embodiments

Figure 3:
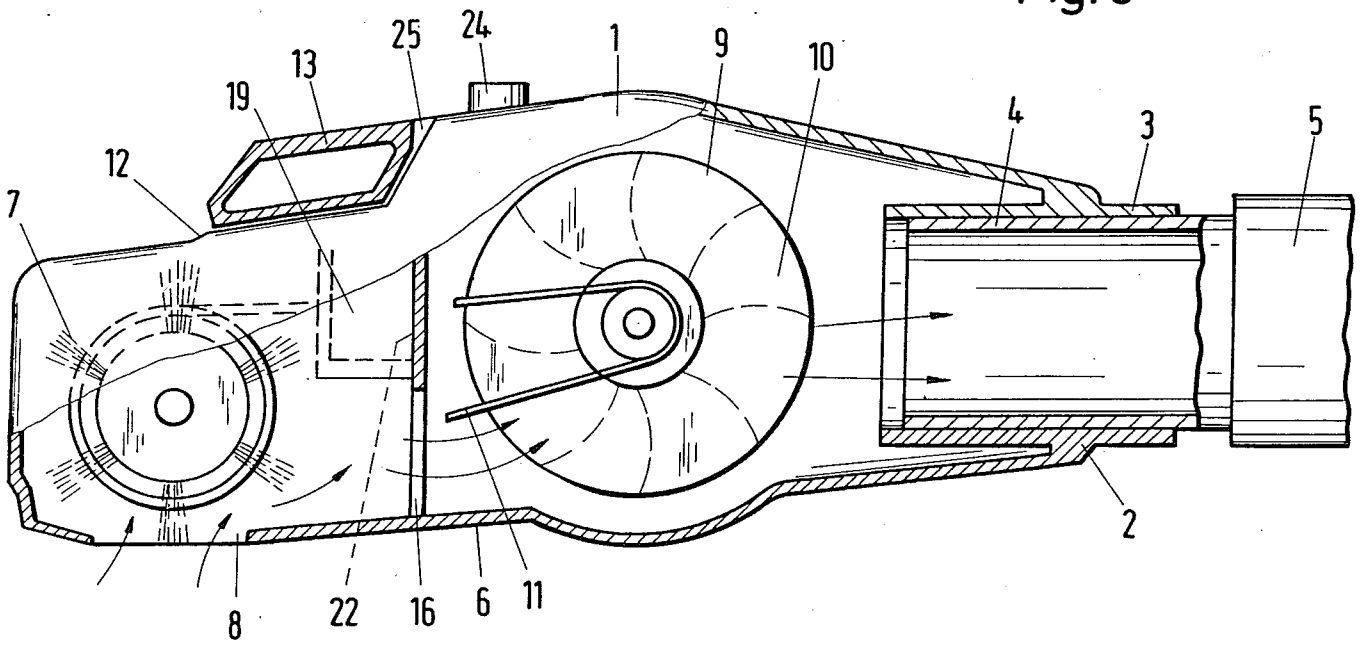
FIG. 3 is a partially cross-sectioned side view of the vacuum-cleaning apparatus taken in the direction of the arrow III in FIG. 1, with the gap-cleaning nozzle in its inoperative position.

Referring now to the drawings in detail, FIGS. 1 to 5 show a vacuum-cleaning tool that has a first vacuum nozzle 1 in the form of a brush nozzle, and a second vacuum nozzle 13 in the form of a gap-cleaning nozzle. The first vacuum nozzle 1 has a housing that includes a lower portion 1a and a cover portion 33 (see also FIGS. 6 and 7). A connection adapter 3 projects beyond the back end 2 of the housing. As shown in FIG. 3, during operation of the tool, the connection adapter 3 is detachably connected to a connector 4 of a vacuum conduit or hose 5 of a non-illustrated vacuum-cleaning unit. Disposed in the front region of the lower portion **1*a* of the housing is a rotatably mounted, cylindrical brush 7 that extends downward slightly beyond an intake or suction opening 8 provided on the bottom side of the lower housing portion 1*a*. The brush 7 is driven mechanically and serves to enhance the cleaning effect. When the brush 7, during operation, glides over an upholstered surface that is to be cleaned, the bristles of the brush extend into the upholstered surface thereby loosening out retained dirt, loose threads, hair, etc., which is then carried away by the stream of intake air. The brush 7 is driven by an air turbine 9 via a belt 11. The air turbine 9 is rotated by the stream of intake air that flows into the lower housing portion 1*a* via an inlet or intake opening 16. After leaving the blades 10 of the air turbine 9, the stream of intake air that flows in during the cleaning process flows through the connection adapter 3, the connector 4, and the vacuum conduit 5** to the vacuum unit. The dirt and dust contained in the stream of intake air is retained in a non-illustrated filter mechanism of the vacuum unit.

To clean narrow, difficult-to-reach gaps between individual upholstered sections, the vacuum-cleaning tool or apparatus is provided with the gap-cleaning nozzle 13, which as shown in FIG. 3 preferably has a flat, rectangular crosssectional shape. In its inoperative position, the gap-cleaning nozzle 13 is accommodated in a recess 25 within the contour of the housing **1*a*, 33 of the first vacuum nozzle 1. The recess 25 is formed by a shoulder-like offset in an upper wall 12 of the cover portion 33 of the housing, so that the forward region of the housing, which is provided with the brush 7, is lower than the downstream region, which is provided with the air turbine 9, by approximately the height of the gap-cleaning nozzle 13**.

Figure 6:
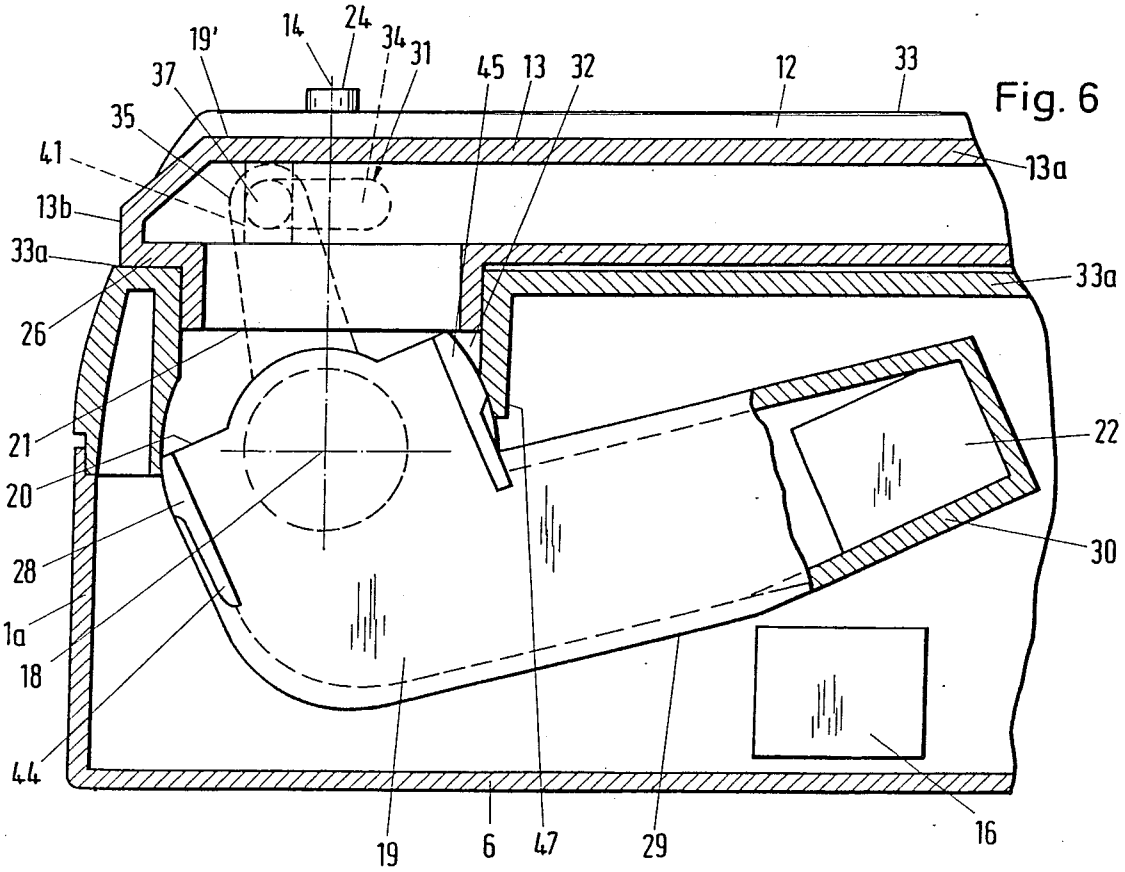
FIG. 6 is an enlarged view of part of the vacuum-cleaning apparatus shown in FIG. 5.
Figure 7:
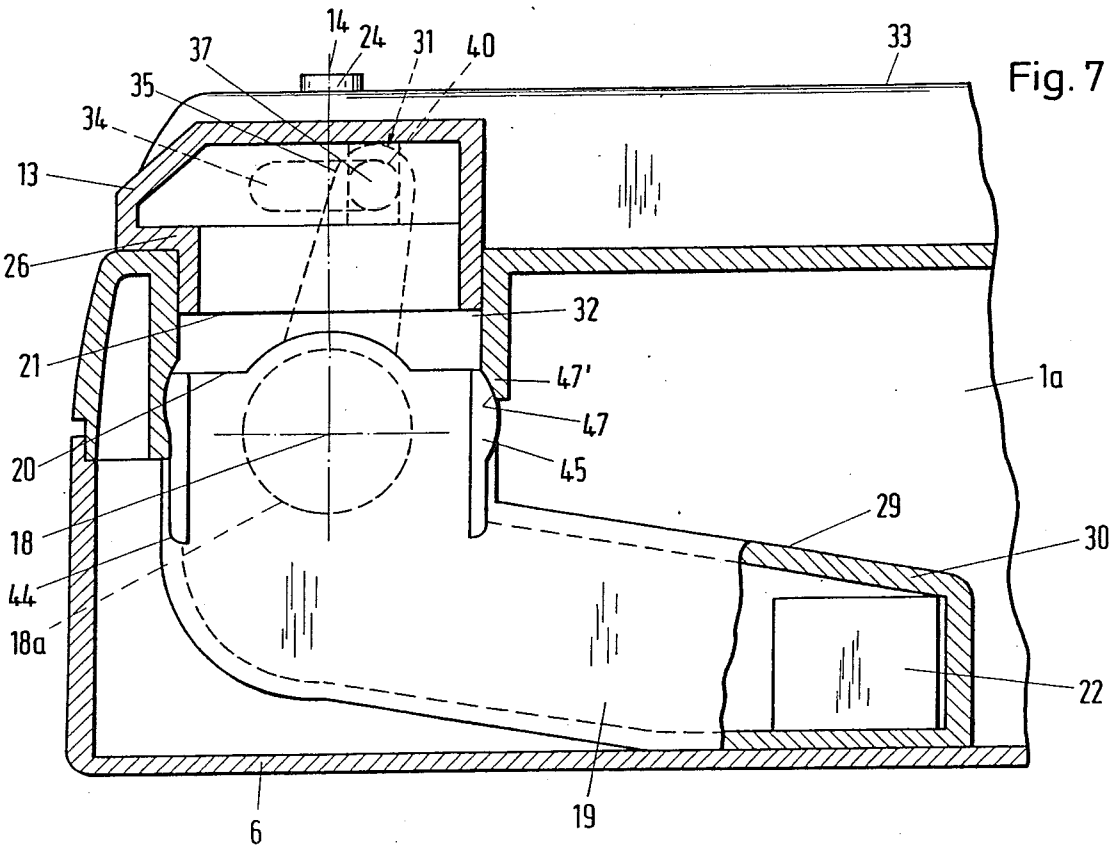
FIG. 7 is an enlarged cross-sectional end view of the vacuum-cleaning apparatus taken in the direction of the arrow VII in FIG. 2.

The gap-cleaning nozzle 13 is pivotably mounted about a pivot axis 14 that is perpendicular to the axis A of the connection adapter 3. The length of the gap-cleaning nozzle 13 is approximately equal to the width of the housing **1*a*, 33 as measured transverse to the axis A of the connection adapter 3. One end 13*a* of the gap-cleaning nozzle 13 is provided with a downwardly extending, preferably cylindrical connection extension 26 (see FIGS. 1 and 5) that has an outlet opening 21 for the stream of intake air that flows in at the other end 27 of the gap-cleaning nozzle 13 via an intake opening 17. The connection extension 26 of the gap-cleaning nozzle 13 extends into a cylindrical opening 32 of the cover portion 33 of the housing. The gap-cleaning nozzle 13 has an overhanging portion 13*b* that projects outwardly beyond the connection extension 26 in a direction opposite to that of the suction element 13*a* itself. As shown in FIGS. 6 and 7, in both the operative and inoperative positions of the gap-cleaning nozzle 13, the overhanging portion 13*b* thereof rests upon a shoulder surface 33*a* of the cover portion 33 of the housing. Via this overhanging portion 13*b*, the gap-cleaning nozzle 13 is reliably supported upon the housing 1*a*, 33** in its operative position.

Figure 1:
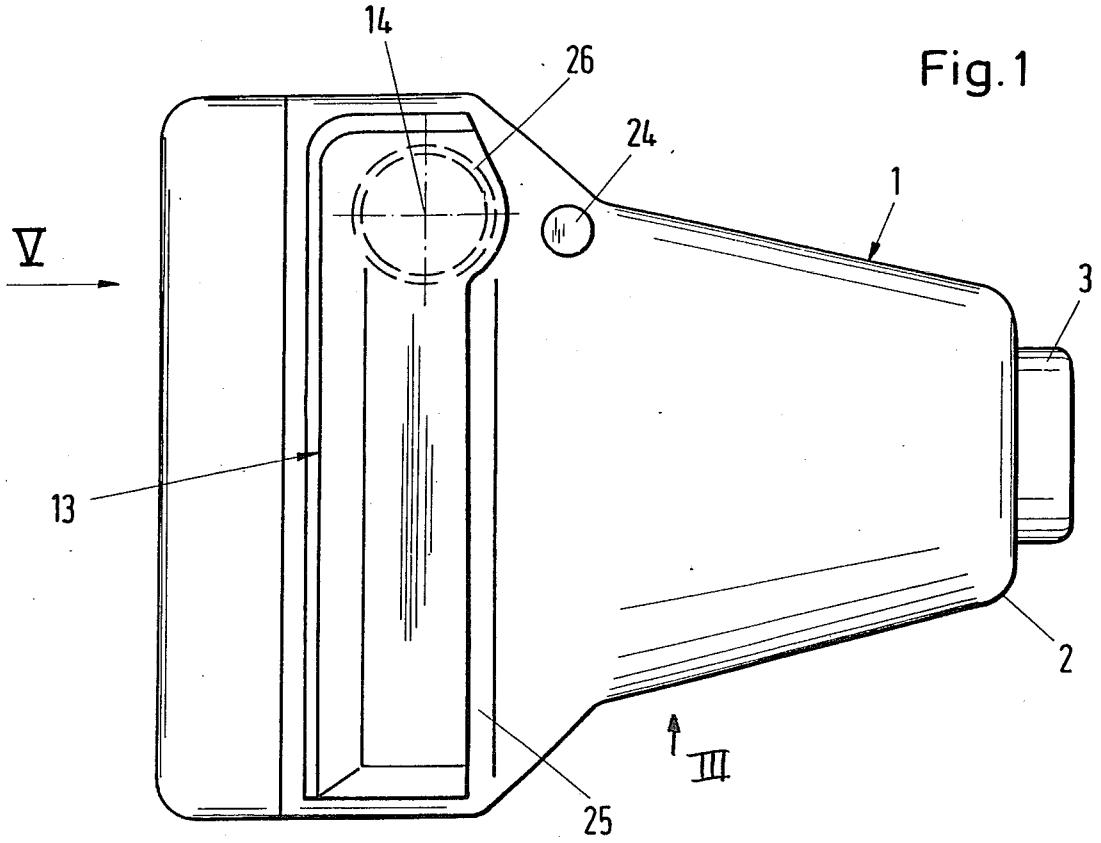
FIG. 1 is a plan view of one exemplary embodiment of the inventive vacuum-cleaning apparatus, with the gap-cleaning nozzle being pivoted into its inoperative position.
Figure 2:
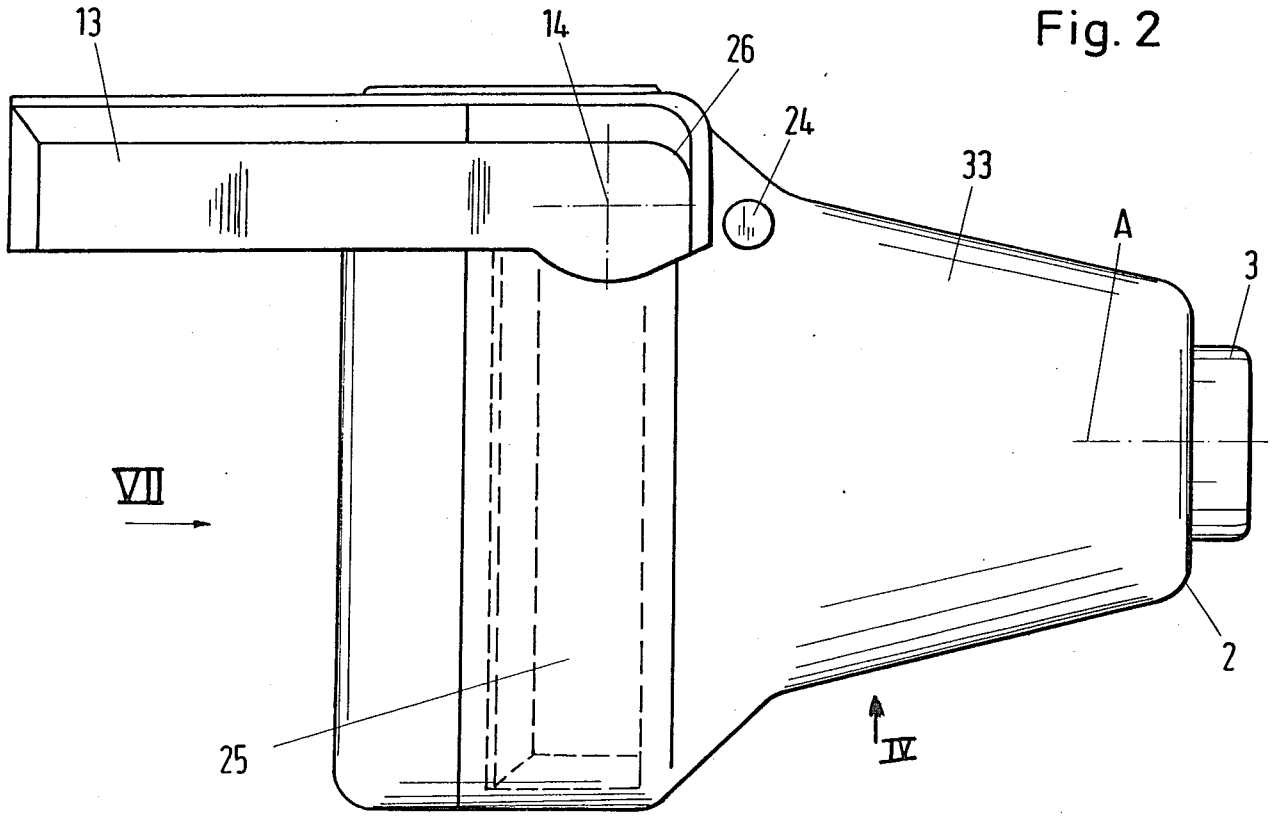
FIG. 2 is a plan view of the vacuum-cleaning apparatus of FIG. 1, with the gap-cleaning nozzle in its operative position.

From its inoperative position illustrated in FIGS. 1 and 3, the gap-cleaning nozzle 13 can be pivoted outwardly by about 90° into an operative position (FIGS. 2 and 4); in so doing, the extension 26 rotates in the opening 32 of the cover portion 33 of the housing. When upholstered surfaces are being cleaned, the bottom 6 of the first vacuum nozzle 1 of the vacuum-cleaning tool rests upon the surface that is to be cleaned and is moved over this surface in such a way that the brush 7 extends into the textile upholstery covering and loosens out the retained dirt, which is then taken along by the stream of intake air and is carried away. In this connection, the stream of intake air flows through the suction opening 8, over the brush 7, through the intake opening 16 of the housing, into the blades 10 of the air turbine 9, and from there via the connection adapter 3 to the vacuum conduit 5. In so doing, the air turbine 9 is rotated and drives the cylindrical brush 7 via the belt 11.

To clean narrow and confined gaps or spaces between the individual upholstered parts, the gap-cleaning nozzle 13 is pivoted out of its inoperative position (FIGS. 1 and 3) by about 90° into its operative position (FIGS. 2 and 4), in which approximately half of the length of the gap-cleaning nozzle 13 projects to the front beyond the housing **1*a*, 33. As a result of this pivoting movement, the flow path of the stream of intake air is altered or deflected in such a way that it no longer flows in through the suction opening 8, but rather flows in through the intake opening 17 that is provided at the free end 27 of the gap-cleaning nozzle 13. In its operative position, the gap-cleaning nozzle 13** can be effortlessly inserted into narrow and confined spaces of the upholstered parts, so that these spaces and gaps can be easily and rapidly cleaned.

Figure 4:
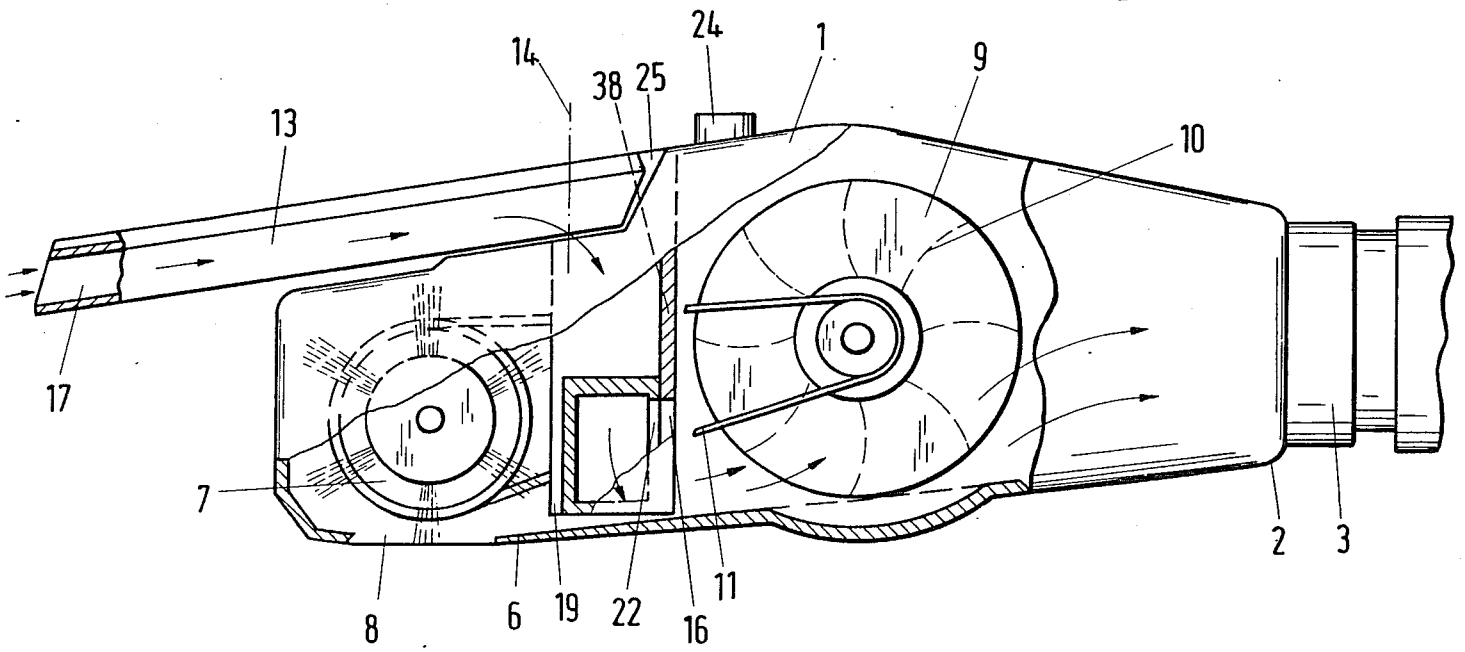
FIG. 4 is a partially cross-sectioned side view of the vacuum-cleaning apparatus taken in the direction of the arrow IV in FIG. 2, with the gap-cleaning nozzle in its operative position.
Figure 5:
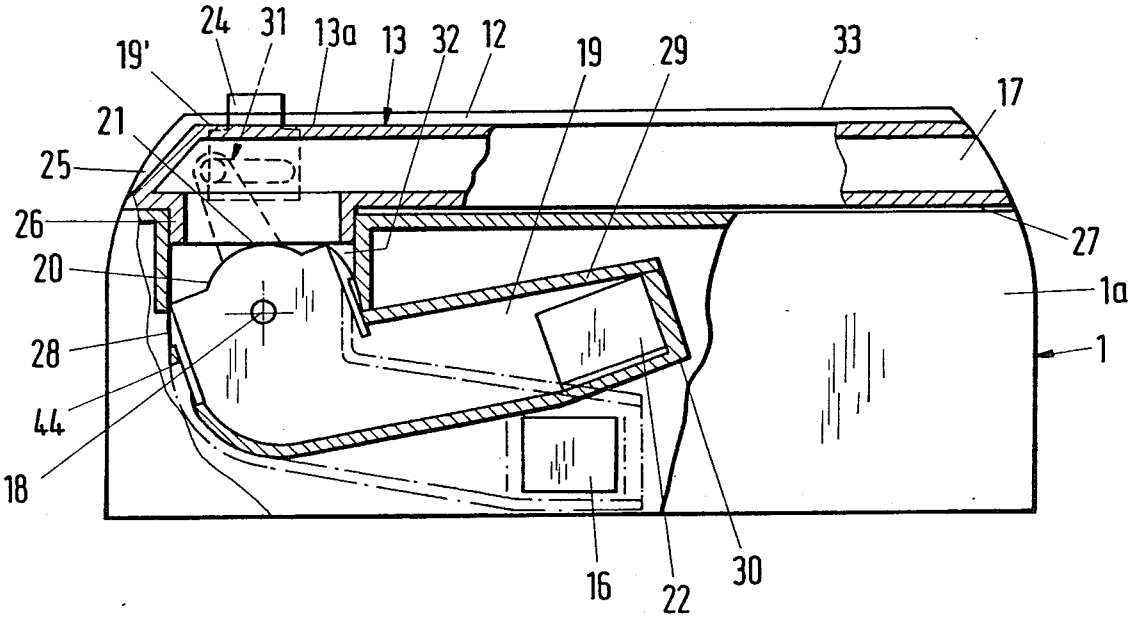
FIG. 5 is a partially cross-sectioned end view of the vacuum-cleaning apparatus taken in the direction of the arrow V in FIG. 1.

The deflection of the stream of intake air when the gap-cleaning nozzle 13 is pivoted outwardly beyond the housing **1*a*, 33 is indicated by arrows in FIG. 4. When the gap-cleaning nozzle 13 is pivoted out of its inoperative position and into its operative position, it comes into in-flow communication with an air duct 19** (see FIGS. 4 to 7). The air duct 19 is pivotable about an axis 18 that extends parallel to the axis A of the connection adapter 3.

The air duct 19 is formed by an angular tube. The pivot axis or shaft 18 extends through a short and preferably cylindrical tubular section 28 that has an opening 20. The other, longer tubular section 29 extends transverse to the axis A of the connection adapter 3. The tubular section 29 preferably has a square or rectangular cross-sectional shape, with one side of the free end 30 being provided with an outlet opening 22. The cross-sectional shape of the outlet opening 22 corresponds to the cross-sectional shape of the inlet or intake opening 16 of the housing 1a, 33. The openings 16 and 22 become aligned with one another when the gap-cleaning nozzle 13 is pivoted into its operative position (FIGS. 2, 4, and 7), whereas the opening 22 is disposed at a distance above the opening 16 when the nozzle 13 assumes its inoperative position (FIGS. 1, 3, 5, and 6). In this inoperative position, the air duct 19 is disposed in such a way that its tubular section 28, i.e. the opening 20 thereof, forms with the outlet opening 21 of the gap-cleaning nozzle 13 an acute angle that is open outwardly toward the adjacent wall of the opening 32 of the housing portion 33. In this position, the other tubular section 29 is inclined upwardly at a slight angle from the bottom 6 of the housing in the direction toward the gap-cleaning nozzle 13. When the latter is pivoted, the air duct 19 is pivoted along with it, so that the opening 20 of the air duct 19 opposite the opening 21 of the connection extension 26 of the nozzle 13 (see FIG. 5) is aligned with this outlet opening 21 (see FIG. 7). In this pivoted position of the air duct 19, which is shown by dot-dash lines in FIG. 5, the free end 30 of the tubular section 29 of the air duct 19 rests upon the housing bottom 6. In this pivoted position of the air duct 19, which is also illustrated in FIG. 7, the flow path of the entire stream of intake air extends through the gap-cleaning nozzle 13. In this position of the nozzle 13, the flow path of the stream of intake air from the intake opening 8, over the brush 7, through the air turbine 9, and to the connector 4 is interrupted. When the gap-cleaning nozzle 13 is pivoted back into its inoperative position, the flow path of the gap-cleaning nozzle 13 is again blocked, and the flow paths through the intake opening 8 of the first suction nozzle 1, over the cylindrical brush 7, and through the air turbine 9 are released.

Since in its operative position the gap-cleaning nozzle 13 communicates with the intake opening 16 via the air duct 19, a very strong suction or stream of intake air exists in the region of the intake opening 17 of the nozzle 13. This suction pulls in any dirt and dust particles that are in the immediate vicinity. Thus, dirt and dust can also be thoroughly removed from narrow and confining gaps or spaces of the upholstered parts, such as cushions. However, it would also be possible to have only a portion of the stream of intake air flow through the gap-cleaning nozzle 13, if, for example, air is also drawn in via the intake opening 8 of the lower portion 1*a* of the housing, with this air then flowing to the connection adapter 3 over the remainder of the flow path, namely the brush 7, the intake opening 16, and the air turbine 9. Such an embodiment could be provided, for example, if the outlet opening 22 of the air duct 19 does not completely cover the intake opening 16 when the air duct 19 is pivoted downwardly as a consequence of the outward pivoting of the gap-cleaning nozzle 13. This would leave open a flow path from the intake opening 8, over the brush 7, through the intake opening 16, through the air turbine 9, and to the connection adapter 3.

Figure 8:
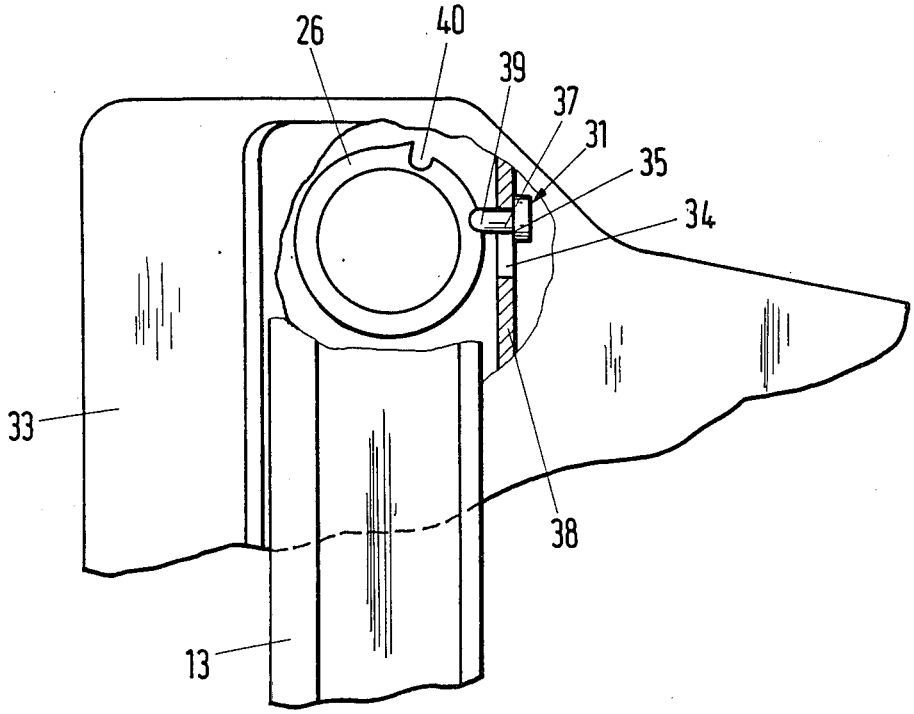
FIG. 8 is a partially cross-sectioned view of part of the vacuum-cleaning apparatus of FIG. 1, and includes a locking mechanism for the gap-cleaning nozzle, which is in the inoperative position.
Figure 9:
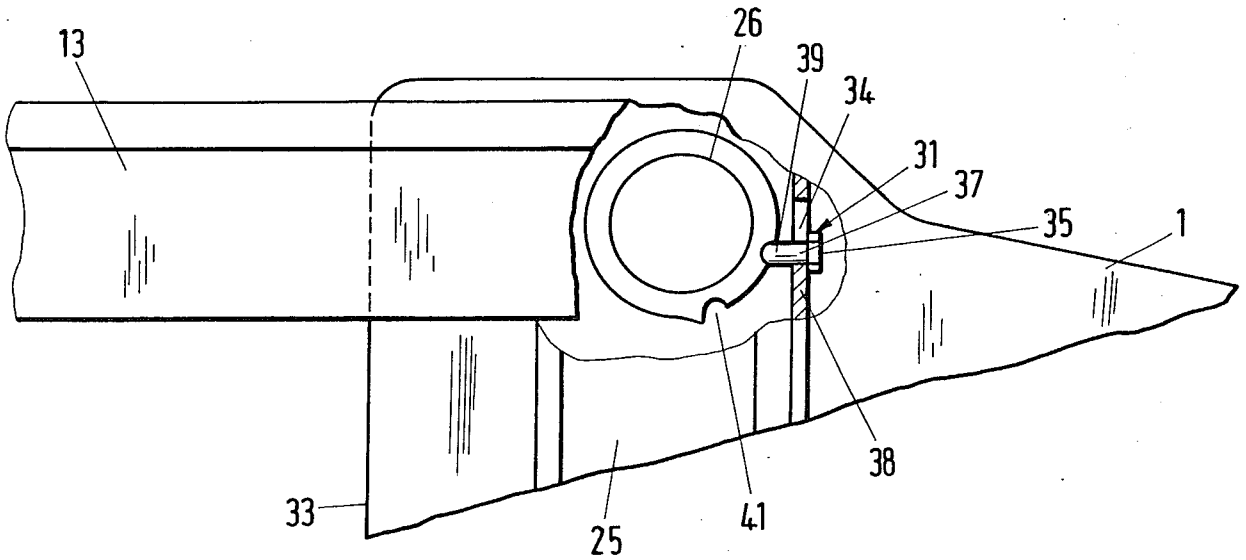
FIG. 9 is a partially cross-sectioned view of part of the vacuum-cleaning apparatus of FIG. 2, and shows a locking mechanism for the gap-cleaning nozzle, which is in the operative position.

As shown in FIGS. 6 to 9, the gap-cleaning nozzle 13 is provided with a locking mechanism 31 to prevent accidental pivoting of the nozzle 13 out of its operative position (FIGS. 2, 4, and 7) and out of its inoperative position (FIGS. 1, 3, 5, and 6). The locking mechanism 31 is embodied in such a way that it is effective without manually actuating a fixing or release mechanism. The locking mechanism 31 comprises a resilient lever 35, a pin 37 that has a rounded end 39, and a first and second arresting recess 40 and 41 that are formed by axially extending grooves on the outer surface of the connection extension 26. The lever 35 extends at right angles upwardly from and beyond a shaft stub 18*a* that defines the pivot axis 18. The ends of the shaft stub 18*a* are supported in the housing 1*a*, 33, and the shaft stub 18*a* is furthermore disposed in a cylindrical, short tubular piece 44, one end of which forms the opening 20. The tubular piece 44 is set into the short, upwardly extending tubular section 28 of the air duct 19 to form a single structural unit. The tubular piece 44 is provided with a thicker, convexly outwardly curved rim or surface portion 45 via which the air duct 19 glides in the housing opening 32 when the air duct is pivoted. In the vicinity of the free end 47, the inner end 47′ of the housing opening 32 is curved concavely outwardly, so that the rim portion 45 of the tubular piece 44 fits in a form-fitting and airtight manner in the end 47. Disposed in the region of the opening 20 of the air duct 19, and the outlet opening 21 of the connection extension 26, is the upwardly projecting lever 35, the upper end of which is provided with the pin 37. This pin 37 projects through a slot 34 of a partition 38 of the lower portion 1*a* of the housing (FIGS. 8 and 9). The rounded off free end 39 of the pin 37 rests in one of the recesses 40 or 41 of the connection extension 26. These recesses are disposed on the peripheral surface of the connection extension 26 at a functionally appropriate distance from one another. When the gap-cleaning nozzle 13 is pivoted out of its inoperative position into its operative position, and vice versa, the connection extension 26 rotates along with the nozzle 13 about the axis 14. As a result, the lever 35, which is connected with the air duct 19 to form a structural unit, is also pivoted, so that the openings 20 and 22 of the air duct 19 are either aligned with the opening 21 and the intake opening 16 of the housing portion 1*a*, or are pivoted away from these openings 16 and 21, depending upon whether the gap-cleaning nozzle 13 assumes its operative or inoperative position. Thus, the stream of intake air can, as needed, be guided either through the gap-cleaning nozzle 13 or through the intake opening 8 and/or the rotating brush 7 to the intake opening 16. Due to the resilient configuration of the lever 35, when the gap-cleaning nozzle 13 is pivoted the pin 37 is automatically lifted out of either the recess 40 or the recess 41 of the connection extension 26. To keep the energy that has to be expended to lift the pin 37 out of the recesses 40 and 41 as low as possible, a release mechanism in the form of the push button 24 is additionally provided (FIGS. 1 to 7). This release mechanism is operatively connected to the lever 35 in such a way when the push button 24 is depressed, a lower wedge surface thereof strikes the lever 35, thereby moving the lever 35 out of its locked position. The push button release mechanism 24 projects upwardly beyond the upper housing wall 12, so that it can be easily actuated.

It should be noted that it would also be possible to provide a third recess on the connection extension 26 between the two recesses 40 and 41, so that if the pin 37 is disposed in this third, intermediate recess, the outlet opening 22 of the air duct 19 would only partly cover the inlet or intake opening 16, thereby providing suction for both the vacuum nozzle 1 and the gap-cleaning nozzle 13 at the intake openings 8 and 17 thereof.

The present invention is, of course, in no way restricted to the specific disclosure of the specification and drawings, but also encompasses any modifications within the scope of the appended claims.

What I claim is:

1. A vacuum-cleaning apparatus that is detachably connected to a vacuum-cleaning unit via a vacuum conduit, said apparatus comprising:

a first vacuum nozzle, which is provided with a brush and includes a housing having a first intake opening therein that leads to said vacuum conduit, with said housing having a second intake opening on an outer portion thereof in the vicinity of said brush;

a second vacuum nozzle, which is embodied as a gap-cleaning nozzle and is pivotably mounted on said housing in such a way as to be pivotable, relative to said first vacuum nozzle, out of an inoperative position into an operative position, and vice versa, with said second vacuum nozzle having two ends, one of which is provided with a third intake opening, and the other of which is provided with a first outlet opening; and an air duct that is pivotably mounted in said housing and has two ends, one of which is provided with an inlet opening, and the other of which is provided with a second outlet opening whereby in said operative position of said second vacuum nozzle, the latter communicates via said first outlet opening thereof with said inlet opening of said air duct, and said second outlet opening of said air duct is aligned with said first intake opening of said housing to establish flow communication from said third intake opening of said second vacuum nozzle to said vacuum conduit, whereas in said inoperative position of said second vacuum nozzle, said second outlet opening of said air duct is no longer aligned with said first intake opening of said housing, thereby establishing flow communication from said second intake opening of said housing to said first intake opening thereof, and hence to said vacuum conduit.

2. A vacuum-cleaning apparatus according to claim 1, in which said second vacuum nozzle, in its inoperative position, is disposed within an outer contour of said apparatus.

3. A vacuum-cleaning apparatus according to claim 1, in which said air duct is a two-part tube comprising a shorter tubular section that is provided with said inlet opening, and a longer tubular section that is provided with said second outlet opening.

4. A vacuum-cleaning apparatus according to claim 3, in which said air duct has a pivot axis that extends through approximately the center of said shorter tubular section thereof.

5. A vacuum-cleaning apparatus according to claim 3, which includes means for operatively connecting said second vacuum nozzle and said air duct in such a way that when said second vacuum nozzle is pivoted out of its inoperative position and into its operative position, said air duct is also pivoted, thereby establishing said communication with said first intake opening of said housing, and hence with said vacuum conduit.

6. A vacuum-cleaning apparatus according to claim 3, in which, in said operative position of said second vacuum nozzle, said first outlet opening of the latter is aligned with said inlet opening of said air duct.

7. A vacuum-cleaning apparatus according to claim 6, in which said shorter tubular section of said air duct has a free end that is remote from said longer tubular section and forms said inlet opening of said air duct; and in which said second vacuum nozzle is provided with a connection extension that is connected to said other end thereof and extends downwardly into said housing at approximately right angles to the remainder of said second vacuum nozzle, with said connection extension having a free end that is remote from said second vacuum nozzle and forms said first outlet opening thereof.

8. A vacuum-cleaning apparatus according to claim 1, in which, in said operative position of said second vacuum nozzle, at least a portion of all of the air that is being sucked into said apparatus flows through said second vacuum nozzle.

9. A vacuum-cleaning apparatus according to claim 1, in which said brush is a cylindrical brush.

10. A vacuum-cleaning apparatus according to claim 9, which includes an air turbine in said housing, with said brush being coupled to said air turbine via a belt drive.

11. A vacuum-cleaning apparatus according to claim 10, in which said air turbine is adapted to be driven by intake air that flows through said first vacuum nozzle.

12. A vacuum-cleaning apparatus according to claim 1, which includes means for selectively securing said second vacuum nozzle in its operative and inoperative positions to prevent accidental pivoting of said second vacuum nozzle out of a given one of these positions.

13. A vacuum-cleaning apparatus according to claim 12, in which said securing means is in the form of a locking mechanism for selectively arresting said second vacuum nozzle in said operative and inoperative positions thereof.

14. A vacuum-cleaning apparatus according to claim 13, in which said locking mechanism includes means for automatically arresting said second vacuum nozzle in said operative and inoperative positions.

15. A vacuum-cleaning apparatus according to claim 13, in which said locking mechanism is operatively interposed between said second vacuum nozzle and said air duct, and includes a lever, a pin, and at least one arresting recess.

16. A vacuum-cleaning apparatus according to claim 15, in which said lever is connected to said air duct to form a single structural component.

17. A vacuum-cleaning apparatus according to claim 16, in which said lever is resilient.

18. A vacuum-cleaning apparatus according to claim 17, in which said lever has an upper end, remote from said air duct, on which is disposed said pin.

19. A vacuum-cleaning apparatus according to claim 18, in which said second vacuum nozzle is provided with a first arresting recess and a second arresting recess; and in which said pin has an end, remote from said lever, that cooperates with said first and second arresting recesses in said operative and inoperative positions of said second vacuum nozzle.

20. A vacuum-cleaning apparatus according to claim 19, which includes a release mechanism, in the form of a push button, that projects upwardly beyond said housing and is adapted to make operative contact with said lever to release said second vacuum nozzle from an arrested position.

* * * * *